US006292989B1

(12) United States Patent
Nomura

(10) Patent No.: US 6,292,989 B1
(45) Date of Patent: Sep. 25, 2001

(54) WARP REPAIR ASSISTING APPARATUS FOR WARPER

(75) Inventor: Takusuke Nomura, Kanazawa (JP)

(73) Assignee: Tsudakoma Kogyo Kabushiki Kaisha, Ishikawa (JP)

( * ) Notice: Subject to any disclaimer, the term of this patent is extended or adjusted under 35 U.S.C. 154(b) by 0 days.

(21) Appl. No.: 09/482,313

(22) Filed: Jan. 14, 2000

(30) Foreign Application Priority Data

Mar. 2, 1999 (JP) ..... 11-054786

(51) Int. Cl.[7] ..... D02H 13/10
(52) U.S. Cl. ..... 28/187; 28/185
(58) Field of Search ..... 28/185, 187

(56) References Cited

U.S. PATENT DOCUMENTS 5,052,088 * 10/1991 Hagewood et al. ..... 28/185
5,295,287 * 3/1994 Chateau ..... 28/187
5,437,082 * 8/1995 Maenaka ..... 28/190
5,446,951 9/1995 Takeuchi et al. ..... 28/187

* cited by examiner

*Primary Examiner*—Andy Falik
(74) *Attorney, Agent, or Firm*—Smith Patent Office

(57) ABSTRACT

An outermost diameter calculation unit for calculating an outermost diameter d of a take-up beam and a correction amount calculation unit in a warp repair assisting apparatus are combined. The correction amount calculation unit calculates a corrected rotation amount θao in the forward direction of the take-up beam necessary to position an abnormal portion of warps at a specified operation position on the take-up beam. A driving unit moves the abnormal portion to the operation position by rotating the take-up beam in the forward direction by an amount corresponding to the corrected rotation amount θao. Therefore, the abnormal portion of the warps can be easily repaired.

23 Claims, 12 Drawing Sheets

WARP REPAIR ASSISTING APPARATUS FOR WARPER

BACKGROUND OF THE INVENTION

The present invention relates to a warp repair assisting apparatus in a warper. The apparatus can easily repair an abnormality of warps when of such an abnormality occur.

DISCUSSION OF THE RELATED ART

A warper has been used to pull and planarly align as many as several thousands of warps, so that the planarly aligned warps can be taken up on a take-up beam to prepare a warp beam for weaving.

It is essential for a warper to immediately make an automatic stop upon an occurrence of an abnormality such as fluffing, end breakage or adhesion of lint and to repair an abnormal portion of warps. This is because the warps, including the abnormal portion, may hinder smooth weaving in a weaving process or degrade the quality of a fabric. In the warper, the warps run by inertia due to an inertia force of a mechanical system including the take-up beam until the warper stops after detect of the abnormal portion. A running distance of the warps by inertia varies depending on parameters such as an outermost diameter (diameter of the warps on the outermost layer on the take-up beam) of the take-up beam and a running speed of the warper. Hereinafter, a movement of a machine or parts caused by an inertia thereof is referred to as "inertia driven running" or "inertia driven run". Accordingly, an operator has to search for the abnormal portion along the running path of the warps after the warper stops. Finding the abnormal portion to repair is not necessarily easy.

In view of the above problem, there has been proposed a repair assisting apparatus capable of easily searching for an abnormal portion of warps (Japanese Unexamined Patent Publication No. 5-321068).

This apparatus measures a running distance of the warps by inertia until a warper stops after the detection of the abnormal portion of the warps, and displays a stop position of the abnormal portion on a display device, has make a search for the abnormal portion easier and simplifies the repair by the operator.

With the above prior art apparatus, the operator needs to search the abnormal portion along the running path of the warps according to the display content of the display device. Depending upon the stop position of the abnormal portion, the operator may have to go below or behind the take-up beam, making the repair extremely difficult. Further, in order to, for example, move the abnormal portion to an operation position set at a front part of the take-up beam, the operator has to calculate a distance from the stop position of the abnormal portion to the operation position on the take-up beam. Such a calculation is cumbersome.

SUMMARY OF THE INVENTION

In view of the problem residing in the prior art, an object of the present invention is to provide a warp repair assisting apparatus in a warper, where the apparatus is provided with an outermost diameter calculation unit and a correction amount calculation unit to easily repair an abnormal portion of warps by simply positioning the abnormal portion to an operation position on a take-up beam.

In order to accomplish the above object, this invention is directed to a warp repair assisting apparatus in a warper, comprising an outermost diameter calculation unit for calculating an outermost diameter of a take-up beam, and a correction amount calculation unit to be combined with the outermost diameter calculation unit, wherein the correction amount calculation unit calculates a corrected rotation amount in the forward direction of the take-up beam, which is necessary to position an abnormal portion of warps at an operation position on the take-up beam, based on the outermost diameter fed from the outermost diameter calculation unit.

With this construction, since the correction amount calculation unit calculates the corrected rotation amount in the forward direction of the take-up beam based on the outermost diameter fed from the outermost diameter calculation unit, an operator can position the abnormal portion at the operation position on the take-up beam by rotating the take-up beam in the forward direction by the amount corresponding to the corrected rotation amount, and can quickly repair the abnormal portion at the operation position. The operation position is set beforehand in a position, for example, at an upper front portion of the take-up beam where the repair can be easily made.

These and other objects, features and advantages of the present invention will become more apparent upon a reading of the following detailed description and accompanying drawings.

DETAILED DESCRIPTION OF THE PREFERRED EMBODIMENTS INVENTION

Hereinafter, embodiments of the invention are described with reference to the accompanying drawings.

Figure 1:
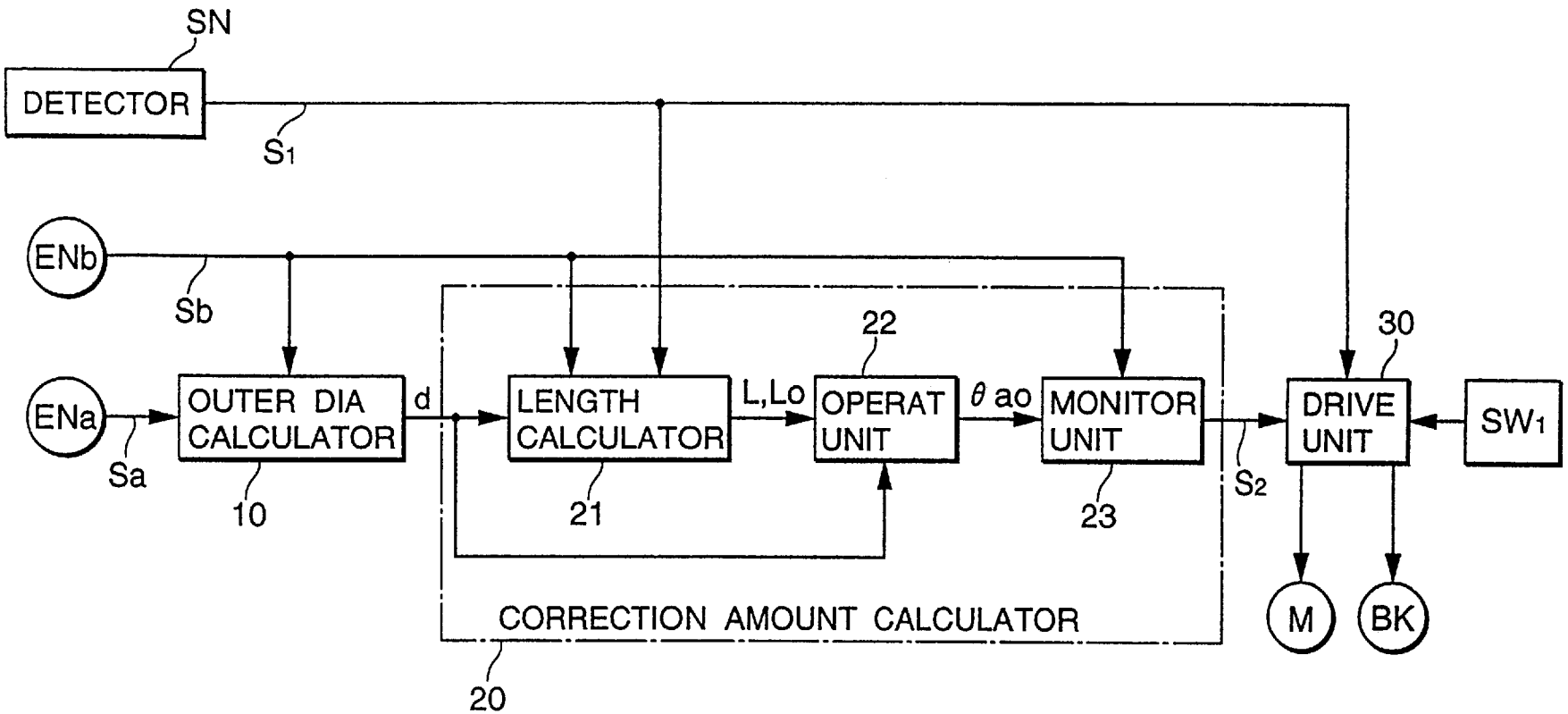
FIG. 1 is an entire schematic block diagram showing a warp repair assisting apparatus in connection with a warper according to a first embodiment of the present invention.
Figure 2:
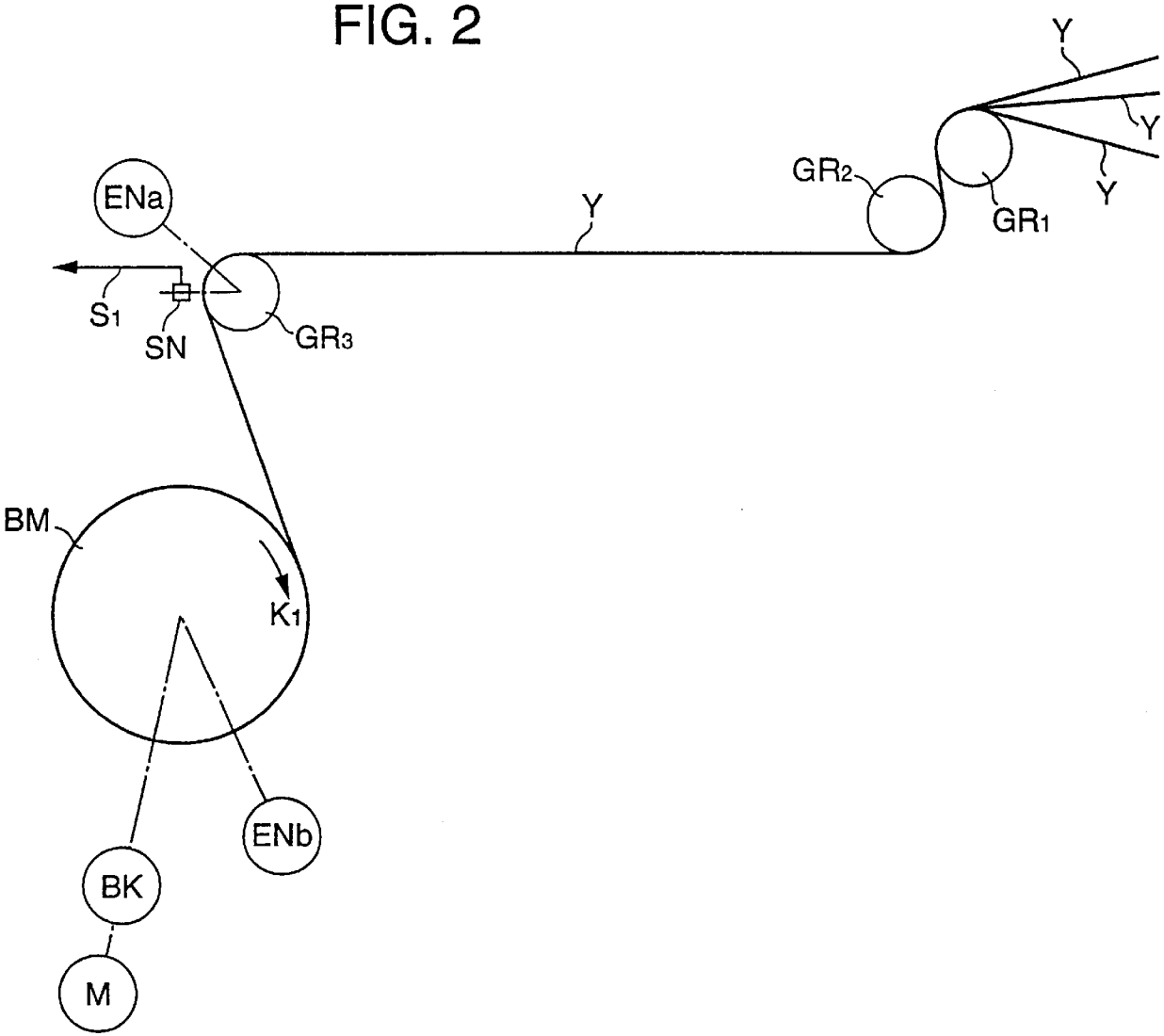
FIG. 2 is a schematic diagram of a warper showing a detector located adjacent a length measuring roller.

A warp repair assisting apparatus of a warper is provided with an outermost diameter calculation unit 10 and a correction amount calculation unit 20 (see FIGS. 1 and 2). A driving unit 30 for rotating a take-up beam BM via a drive motor M is combined with the correction amount calculation unit 20.

The warper is provided with guide rollers GR1, GR2 on an upstream side, a length-measuring roller GR3 on a downstream side and a take-up beam BM. On the guide roller GR1, a multitude of warps Y, Y, . . . (hereinafter, merely warps Y) drawn from an unillustrated creel are pulled and planarly aligned. The warps Y are taken up by the take-up beam BM via the guide rollers GR1, GR2 and the length-measuring roller GR3.

An encoder ENa is coupled to the length-measuring roller GR3, and a detector SN for detecting an abnormal portion of the warps Y such as fluff, lint or end breakage and outputting a detection signal S1 is provided before the length-measuring roller GR3. To the take-up beam BM are coupled a braking device BK, the drive motor M and an encoder ENb. The encoder ENa outputs a pulse representing a pulse number Nao as an output signal Sa while the roller GR3 makes one turn, whereas the encoder ENb outputs a pulse representing a pulse number Nbo as an output signal Sb while the take-up beam BM makes one turn.

The output signals Sa, Sb are input to outermost diameter calculation unit 10 from the encoders ENa, ENb. The output of the outermost diameter calculation unit 10 is fed to a length calculating unit 21 and an operating unit 22 of the correction amount calculation unit 20. The detection signal S1 of the detector SN and the output signal Sb of the encoder ENb are input to the length calculating unit 21. The output of the length calculating unit 21 is then input to a monitoring unit 23 via the operating unit 22. An output of the monitoring unit 23 is inputted as a control signal S2 to the driving unit 30. The output signal Sb of the encoder ENb is also inputted to the monitoring unit 23, and an output of the driving unit 30 is individually inputted to the drive motor M and the braking device BK. Further, the detection signal Si of the detector SN is also input to the driving unit 30, which is provided with a switch SW1.

The warp repair assisting device in such a warper operates as follows.

In the warper, the take-up beam BM is rotated in a forward direction (direction of arrow K1 of FIG. 2) via the driving unit 30 and the drive motor M to take up the warps Y via the guide rollers GR1, GR2 and the length-measuring roller GR3. At this time, the detector SN monitors the warps Y passing a monitoring position on the outer surface of the length-measuring roller GR3 over the entire width (see FIG. 3).

The outermost diameter calculation unit 10 calculates an outermost diameter d of the take-up beam BM in accordance with the output signals Sa, Sb of the encoders ENa, ENb at specified set periods. In other words, the outermost diameter calculation unit 10 counts the pulse number Na of the output signal Sa of the encoder ENa and the pulse number Nb of the output signal Sb of the encoder ENb within the set period and then calculates the outermost diameter d of the take-up beam BM as follows:

$$\pi d(Nb/Nbo)=\pi da(Na/Nao) \text{ thus } d=da((Na\cdot Nbo)/(Nb-Nao))$$

The outermost diameter calculation unit 10 outputs the result to the correction amount calculation unit 20 for set period. The outermost diameter calculation unit 10 may count the pulse numbers Na, Nb from the encoders ENa, ENb at measurement periods that are sufficiently smaller than the set period, calculate the outermost diameter d and the output an average value of the outermost diameter d within the set period to the correction amount calculation unit 20 at every set period.

Figure 3:
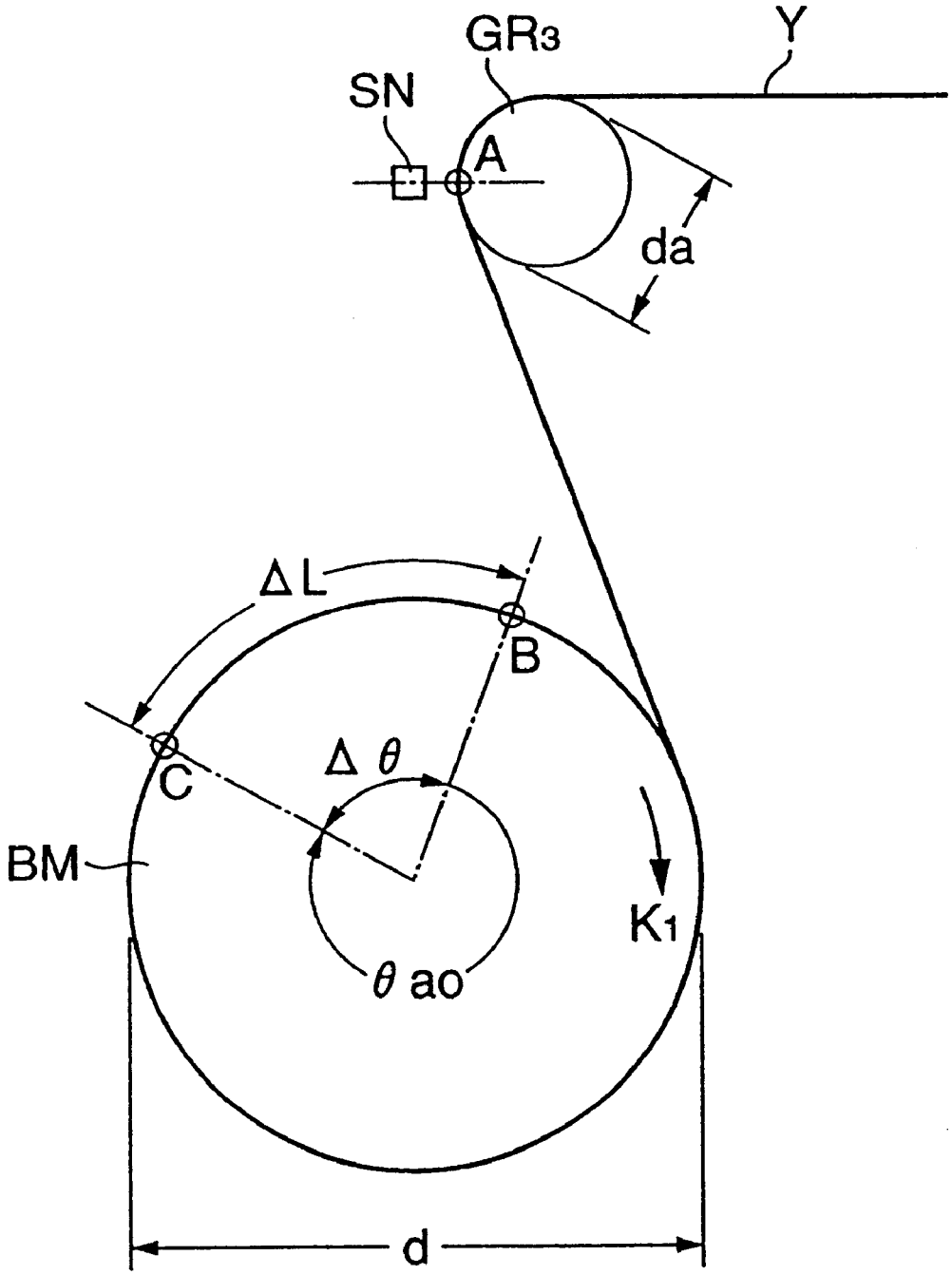
FIG. 3 is a diagram showing an operation of a take-up beam according to the first embodiment of the present invention.

The detector SN outputs the detection signal S1 upon detecting an abnormal portion of the warps Y. Upon the output of the detection signal Si from the detector SN, the driving unit 30 actuates the braking device BK and controllably stops the drive motor M, thereby quickly stopping the warper. The warper stops the movement of the warps Y after allowing them to run by inertia due to an inertia force of the mechanical system including the take-up beam BM. As a result the abnormal portion of the warps Y continue to move from the monitoring position A to the stop position B on the take-up beam BM until the warper stops. In FIG. 3, the operation position C is set to a specified position at the front upper side of the outer surface of the take-up beam BM, and the abnormal portion of the warps Y detected at the monitoring position A is moved to the stop position B after passing the operation position C once due to the inertia driven running of the warps Y.

Accordingly, the length calculating unit 21 can calculate an inertia rotation amount Nb1/Nbo of the take-up beam BM by counting the pulse number Nb1 of the output signal Sb that is output from the encoder ENb until the warper stops after the output of the detection signal S1 from the detector SN. The length calculating unit 21 judges that the warper has come to a complete stop if no output signal Sb from the encoder ENb has been inputted thereto over a predetermined time e.g. several seconds. Then it calculate the inertia rotation amount Nb1/Nbo. The length calculating unit 21 can also calculate an inertia driven running distance $L=\pi d(Nb1/Nbo)$, by which the abnormal portion of the warps Y moves during the inertia operation of the warper, in accordance with the outermost diameter d of the take-up beam BM and the inertia driven rotation amount Nb1/Nbo when the warper stops. This running distance is then output to the operating unit 22. Note that the term "an inertia driven running distance" is used to mean a running distance of warps due to the inertia movement of the warper even though no drive force is applied to the warper. Similarly, the term "an inertia rotation amount" or "an inertia driven rotation amount" is used to mean a rotational amount caused by the inertia movement of the warper even though no drive force is continuously applied to the warper. Similar interpretations should be given to the terms accompanying the phraser "an inertia" or "an inertia driven" unless otherwise specifically indicated to the contrary.

Further, the length calculating unit 21 can calculate a reference length Lo between the monitoring position A and the operation position C on the running path of the warps Y in accordance with the outermost diameter d from the outermost diameter calculation unit 10. Here, the running path of the warps Y is referred to as a path of the warps Y extending from the guide rollers GR1, GR2 to the outer surface of the take-up beam BM via the length-measuring roller GR3. The reference length Lo can be calculated as a function of the outermost diameter d of the take-up beam BM in accordance with a relative positional relationship and a distance between the centers of the rotation of the length-measuring roller GR3 and the take-up beam BM, and a diameter of the length-measuring roller GR3. In other words, $$Lo=f(d):$$

The length calculating unit 21 may calculate the reference length Lo every time the outermost diameter d from the outermost diameter calculation unit 10 is renewed or only when the warper stops upon the output of the detection signal S1 from the detector SN.

The operating unit 22 calculates a relative distance $\Delta L=L-Lo$ between the stop position B and the operation position C on the running path of the warps Y based on the inertia driven running distance L and the reference length Lo of the length calculating unit 21. It then calculates a relative rotation amount $\Delta\theta$ of the take-up beam BM corresponding to the relative distance $\Delta L$ based on the outermost diameter d. In other words, $\Delta L/(\pi d)=\Delta\theta/(2\pi)$, therefore, $\Delta\theta=2\Delta L/d$.

The operating unit 22 also calculates a passage number n (n=0, 1, 2, . . . ) by which the abnormal portion of the warps Y passes the operation position C during its inertia run. In other words, the operating unit 22 calculates the passage number n based on the outermost diameter d and the relative distance $\Delta L$ or relative rotation amount $\Delta\theta$:

$$n=\Delta L/(\pi d)=\Delta\theta/(2\pi).$$

It should be noted that the passage number n=0 when the relative distance $\Delta L\leqq 0$ and $n\leqq 0$, and n=an integer greater than 0 by raising any values with decimals to the next whole number when n>0.

Accordingly, the operating unit 22 can calculate a corrected rotation amount $\theta ao=2\pi n-\Delta\theta$ in the forward direction of the take-up beam BM which is necessary to position the abnormal portion of the warps Y at the operation position C based on the relative rotation amount $\Delta\theta$ and the passage number n. The operating unit 22 then outputs it to the monitoring unit 23. Specifically, the operating unit 22 calculates the corrected rotation amount $\theta ao=|\Delta\theta|$ when $\Delta L<0$ and $\theta ao=0$ when $\Delta L=0$. Further, the operating unit 22 calculates the corrected rotation amount $\theta ao=2\pi n-\Delta\theta$ when $\Delta L>0$. The corrected rotation amount $\theta ao$ is: $0\leqq\theta ao<2\pi$ despite the passage number n. In other words, the relative rotation amount $\Delta\theta=2\pi a+b$ where $a=(n-1)$ which is 0 or a positive integer and $0\leqq b\leqq 2\pi$. Therefore, the corrected rotation amount $\theta ao$ can be calculated as follows:

$$\begin{aligned}\theta ao &= 2\pi n-(2\pi(n-1)+b)\\ &= 2\pi-b<2\pi.\end{aligned}$$

The monitoring unit 23 outputs the control signals S2 to the driving unit 30 upon receipt of the corrected rotation amount $\theta ao>0$ from the operating unit 22. The driving unit 30 operates the switch SW1 when the control signal S2 from the monitoring unit 23 is present, thereby rotating the take-up beam BM at a low speed in the forward direction via the drive motor M to make a correction. At this time, the monitoring unit 23 can monitor a rotation amount $\theta a=2\pi(Nb2/Nbo)$ using the output signal Sb from the encoder Enb and cause the control signal S2 to disappear upon detecting $\theta a\leqq\theta ao$. Also the driving unit 30 can automatically stop the take-up beam BM via the braking device BK. Here, Nb2 is a pulse number of the output signal Sb output from the encoder Enb when the take-up beam BM is caused to rotate to make a correction rotation. The take-up beam BM is rotated only by an amount corresponding to the corrected rotation amount $\theta ao$ to position the abnormal portion by moving it from the stop position B to the operation position C. As a result, the operator can find the abnormal portion of the warps Y at the operation position C and easily repair it.

In the above description, the operating unit 22 does not need to calculate the corrected rotation amount $\theta ao$ if the stop position B of the abnormal portion of the warps Y is located in vicinity of the operation position C. Specifically, the operating unit 22 keeps the warper from moving by setting the corrected rotation amount $\theta ao=0$, for example, when $|\Delta\theta|\leqq\pi/18$. At this time, the operator searches the abnormal portion of the warps Y near the operation position C and repairs it.

If a slip of the warps Y on the length-measuring roller GR3 is negligible, the length calculating unit 21 can calculate the inertia driven running distance $L=\pi da\ (Nal/Nao)$ of the warps Y in accordance with the output signal Sa from the encoder ENa. It should be noted that Na1 is a pulse number of the output signal Sa output from the encoder ENa until the warper stops after the detector SN detects the abnormal portion of the warps Y.

The calculating unit 22 may calculate the corrected rotation amount: $\theta ao=2\pi(n+1)-\Delta\theta$. The abnormal portion of the warps Y moves to the operation position C after passing the operation position C once and makes one round on the take-up beam BM. The driving unit 30 may not be provided with the switch SW1 and may automatically cause the take-up beams BM to make only a correction rotation corresponding to the corrected rotation amount $\theta ao$ if the corrected rotation amount $\theta ao$ from the correction amount calculation unit 20 is larger than 0.

Figure 4:
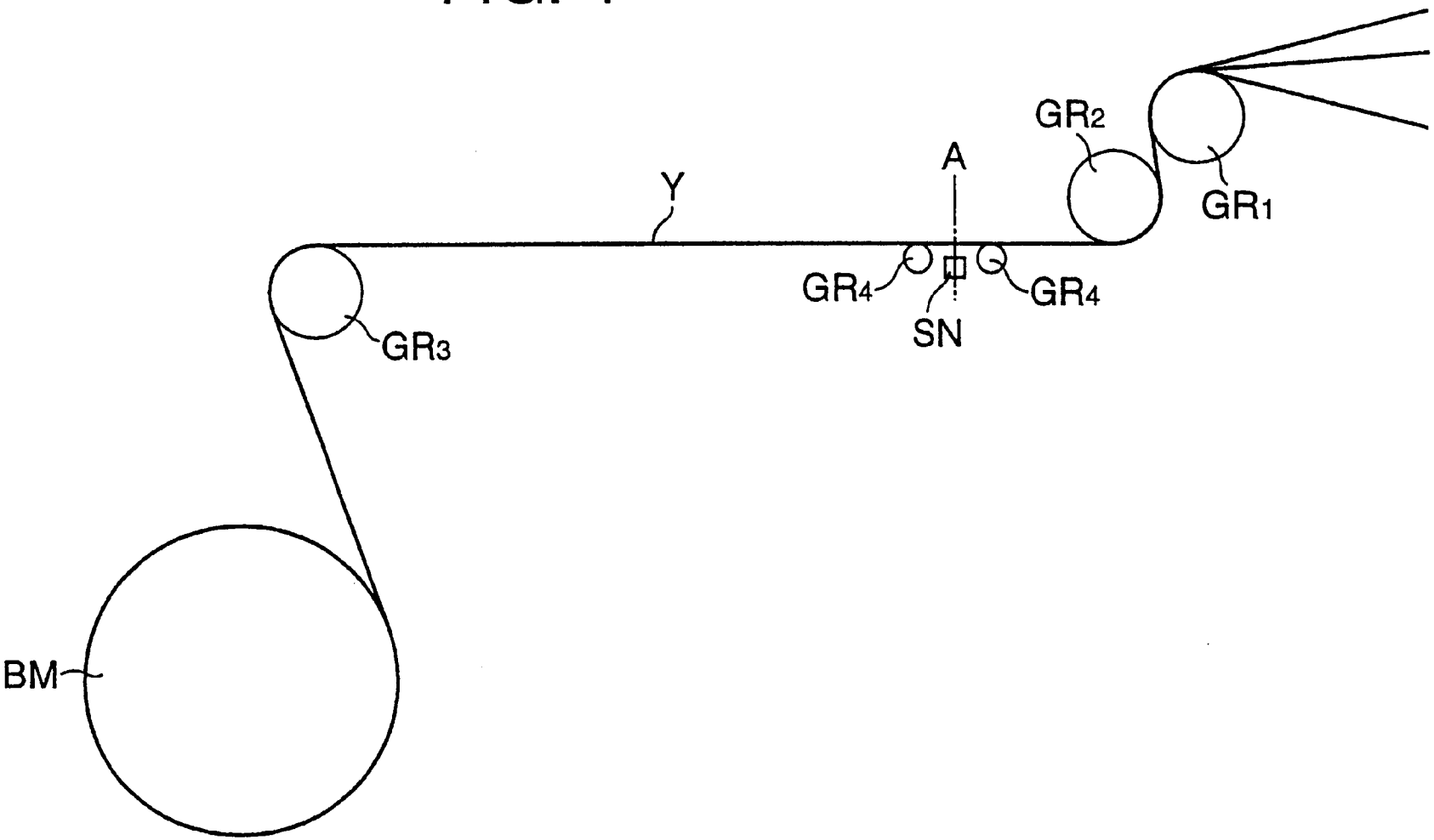
FIG. 4 is a schematic diagram, corresponding to FIG. 2, showing a detector disposed upstream of the length measuring roller according to another embodiment of the present invention.

The detector SN may be provided between the guide roller GR2 and the length-measuring roller GR3 as shown in FIG. 4. The monitoring position A for the warps Y may be largely distanced toward the upstream side from the take-up beam BM. At the upstream and downstream sides of the detector SN are provided auxiliary rollers GR4, respectively. Alternatively, the detector SN may be provided downstream of the length-measuring roller GR3. In either case, the calculating unit 22 may set the corrected rotation amount $\theta ao$: $\theta ao=2\pi n-\Delta\theta$. This is because the relative distance $\Delta L$ necessary to calculate the corrected rotation amount $\theta ao$ can be calculated by $\Delta L=L-Lo$ independently of the set position of the monitoring position A.

Figure 5:
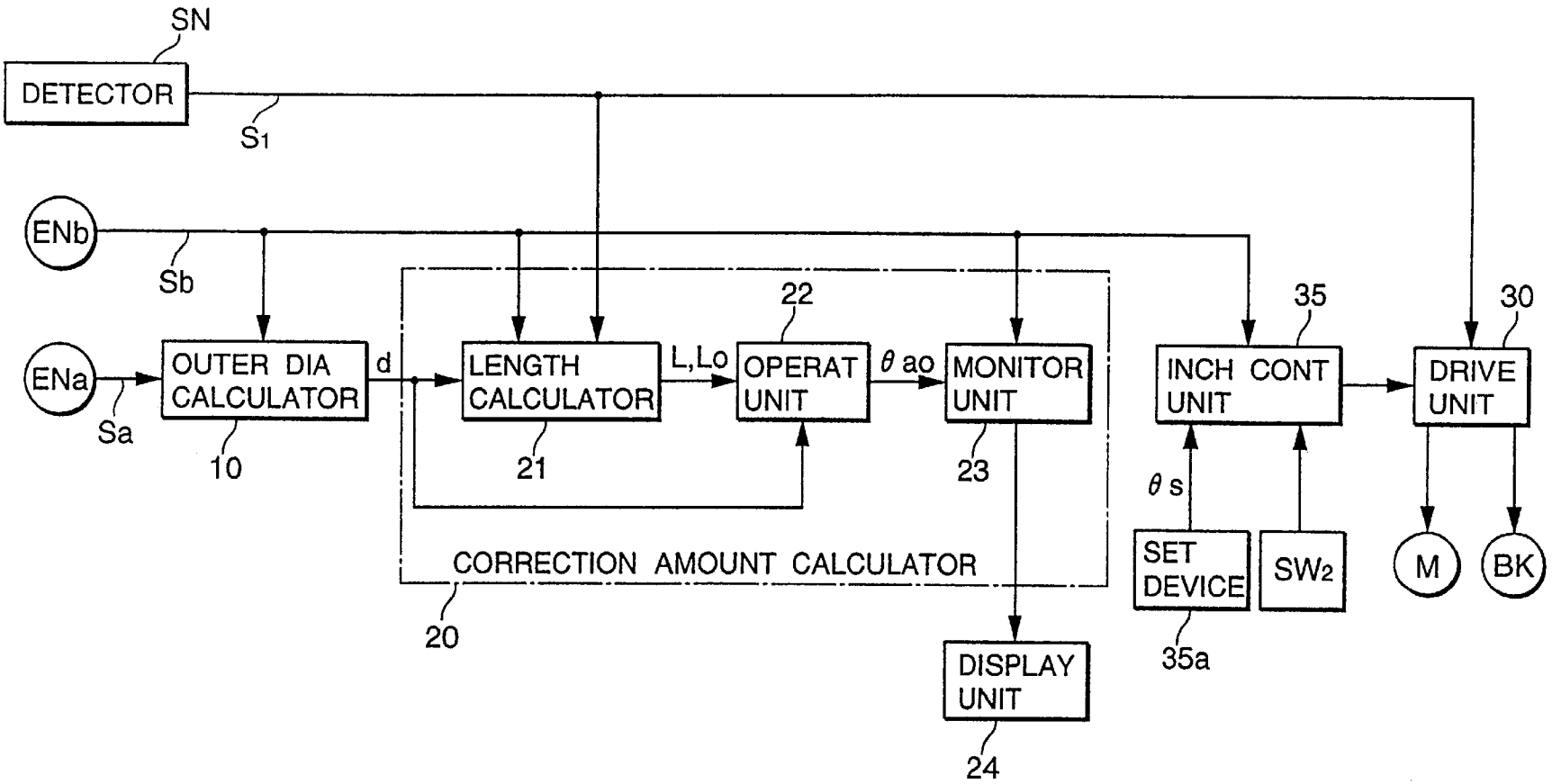
FIG. 5 is an entire schematic block diagram, similar to FIG. 1, showing a warp repair assisting apparatus with an inching control unit according to still another embodiment of the present invention.

The driving unit 30 may be combined with an inching brake control unit 35 instead of being combined with the correction amount calculation unit 20 (as shown FIG. 5). To the inching control unit 35 is inputted the output signal Sb of the encoder ENb. A setting device 35*a* and a switch SW2 for setting an inching rotation amount $\theta s$ of the take-up beam BM are individually provided. On the other hand, a display device 24 is connected with the monitoring unit 23 of the correction amount calculation unit 20.

The correction amount calculation unit 20 can cause the display device 24 to make a real-time display of a specified rotation amount ($\theta ao-\theta a$) of the take-up beam BM necessary to move the abnormal portion of the warps Y to the operation position C. The operator operates the switch SW2 while viewing the specified rotation amount ($\theta ao-\theta a$) displayed on the display device 24. The inching control unit 35 causes the take-up beam BM to inch by the inching rotation amount $\theta s$ via the drive motor M every time the switch SW2 is operated, thereby moving the abnormal portion of the warps Y to the vicinity of the operation position C.

Figure 6:
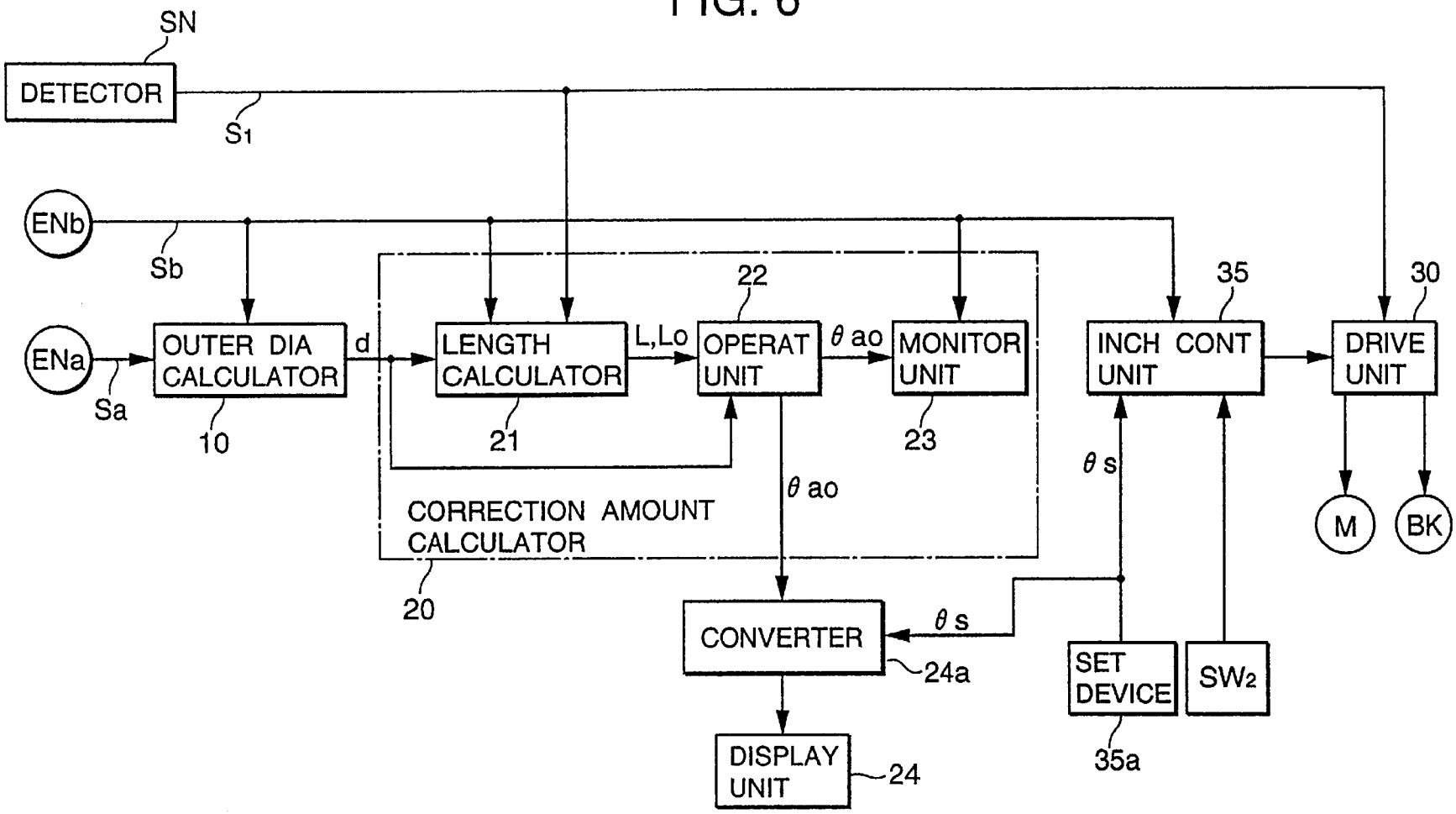
FIG. 6 is an entire schematic block diagram, similar to FIG. 5, showing a warp repair assisting apparatus with an inching control unit and a converter according to further another embodiment of the present invention.

The display device 24 of FIG. 5 may be connected with the operating unit 22 via a converter 24*a* (as shown FIG. 6).

The inching rotation amount θs is inputted to the converter 24*a* from the setting device 35*a*. The converter 24*a* can then calculate an inching number N=θao/θs (N=0, 1, 2 . . . ) based on the corrected rotation amount θao from the operating unit 22 and display it on the display device 24. It should be noted that the inching number N is a positive integer or 0 obtained by rounding decimals of θao/θs off to the nearest whole number. The operator may operate the switch SW2 of the inching control unit 35 only by the inching number N displayed on the display device 24.

The display device 24 of FIG. 6 may be directly connected with the operating unit 22 instead of being connected via the converter 24*a*. In such a case, the operator may calculate the necessary inching number N=θao/θs (N=0, 1, 2 . . . ) based on the corrected rotation amount θao displayed on the display device 24 and the inching rotation amount θs set in the setting device 35*a* and operate the switch SW2 accordingly. Alternatively, the converter 24*a* may be connected with the monitoring unit 23 instead of being connected with the operating unit 22 in FIG. 6. In such a case, the display device 24 can display the necessary inching number N=(θao−θa)/θs (N=0, 1, 2 . . . ) in real time.

Figure 7:
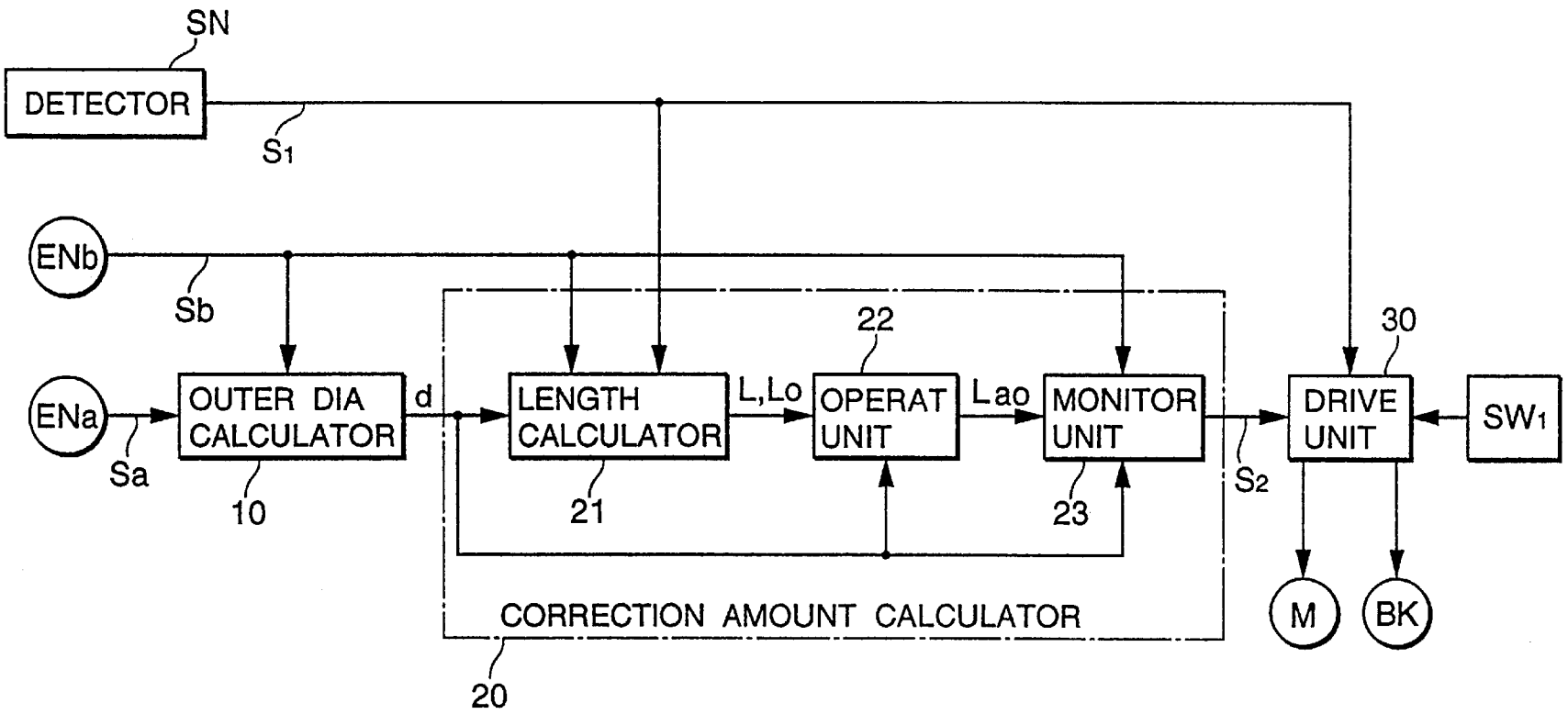
FIG. 7 is an entire schematic block diagram, similar to FIG. 1, showing a warp repair assisting apparatus using a corrected take-up length according to a still further embodiment of the present invention.
Figure 8:
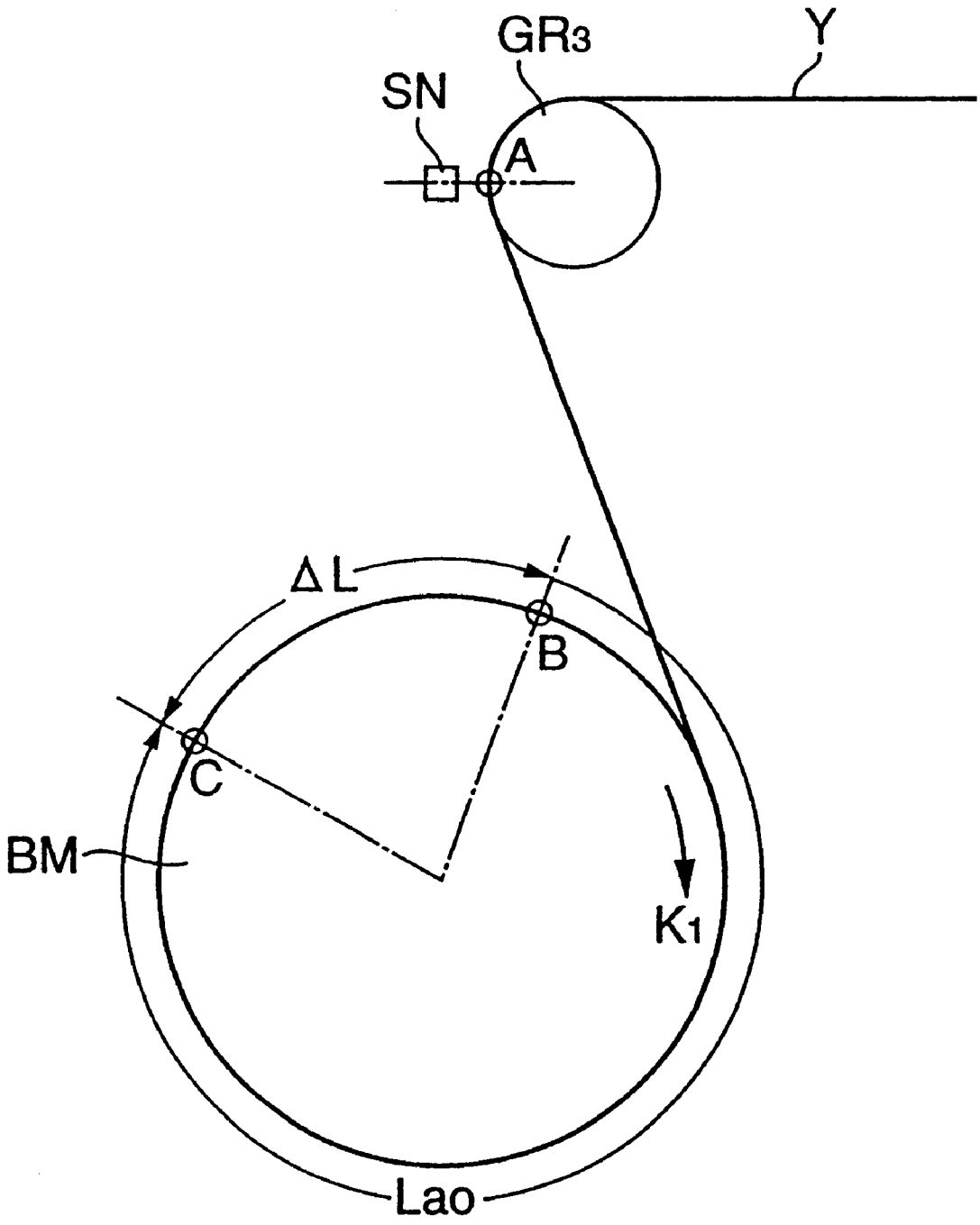
FIG. 8 is a schematic diagram showing an operation of the warper using a corrected take-up length according to the embodiment of FIG. 7.

The operating unit 22 of the correction amount calculation unit 20 may also output a corrected take-up length Lao to the monitoring unit 23 instead of the corrected rotation amount θao as shown in FIGS. 7 and 8. The outermost diameter d from the outermost diameter calculation unit 10 is also input to the monitoring unit 23.

The operating unit 22 can calculate a corrected take-up length Lao in the forward direction of the take-up beam BM necessary to position the abnormal portion of the warps Y at the operation position C based on the relative distance ΔL and the passage number n by Lao=πdn−ΔL and output it to the monitoring unit 23. The monitoring unit 23 outputs the control signal S2 to the driving unit 30 upon receipt of the corrected take-up length Lao>0 from the operating unit 22, and the driving unit 30 causes the take-up beam BM to make a correction rotation via the drive motor M.

At this time, the monitoring unit 23 monitors a take-up length La=πd (Nb2/Nbo) by which the warps Y are taken up by the take-up beam BM based on the output signal Sb of the encoder ENb and the outermost diameter d fed from the outermost diameter calculation unit 10. Further, the monitoring unit 23 causes the control signal S2 to disappear upon detecting La≧Lao, and the driving unit 30 causes the take-up beam BM to stop in a suitable position via the braking device BK. During this time, the take-up beam BM takes up the warps Y by an amount corresponding to the corrected take-up length Lao to move the abnormal portion of the warps Y from the stop position B to the operation C.

The correction amount calculation unit 20 of FIG. 7 is also applicable to the embodiments of FIGS. 5 and 6.

Figure 9:
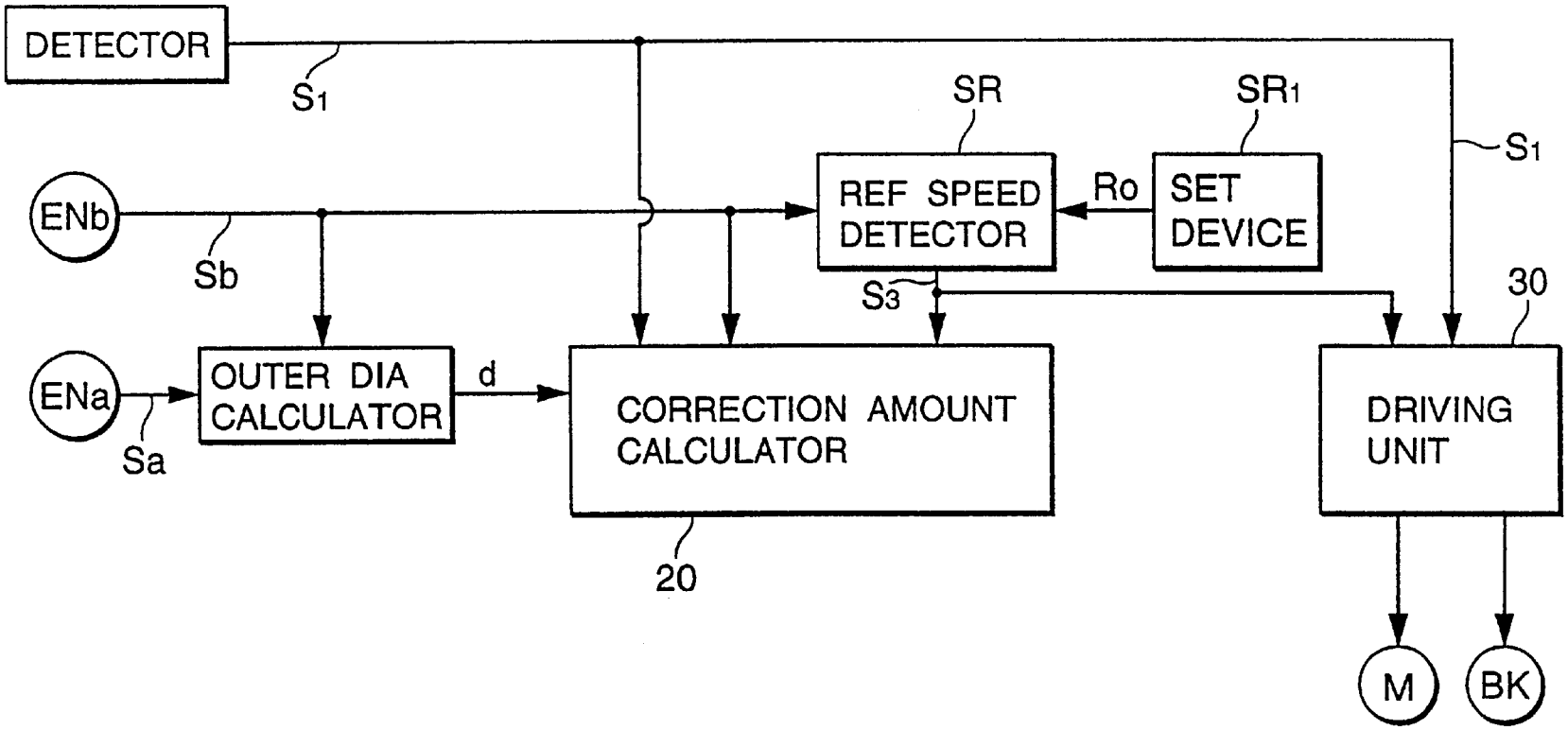
FIG. 9 is a schematic block diagram showing a warp repair assisting apparatus including a reference rotation number detector according to another embodiment of the present invention.
Figure 10:
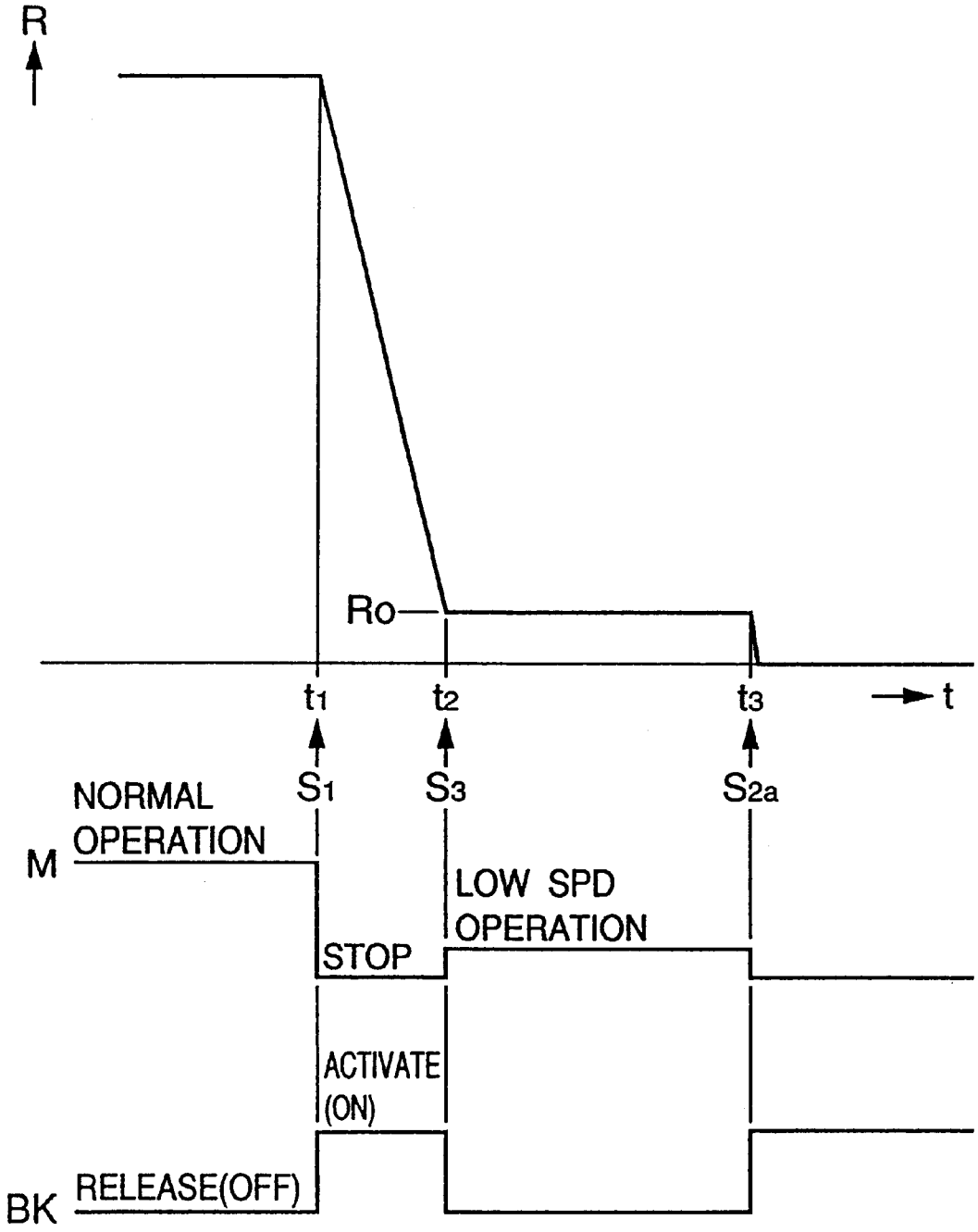
FIG. 10 is a diagram of the timing of the rotation number, the motor and the brake according to the embodiment of FIG. 9.

The correction amount calculation unit 20 may be additionally provided with a reference rotation number detector SR for detecting the rotation number of the take-up beam BM as shown in FIGS. 9 and 10. This detector SR includes a setting device SR1 for setting a reference rotation number Ro. An output of the detector SR is input as a detection signal S3 to the correction amount calculation unit 20 and the driving unit 30. The detector SR detects a rotation number R of the take-up beam BM using the output signal Sb from the encoder ENb, and outputs the detection signal S3 upon detecting R≦Ro. An output of the rotation amount calculating means 20 is inputted as a stop signal S2*a* to the driving unit 30.

The driving unit 30 stops the drive motor M upon receipt of the detection signal S1 from the detector SN (time t=t1 in FIG. 10, indicated merely by (t=t1) hereinafter) and enters a decelerated inertia driven operation (t1≦t<t2) to stop the take-up beam BM by actuating the braking device BK. Upon receipt of the detection signal S3 from the reference rotation number detector SR when the rotation number R of the take-up beam BM becomes equal to or smaller than the reference rotation number Ro, that is R≦Ro (t=t2), the driving unit 30 deactivates the braking device BK and drives the drive motor M at low speed, thereby continuously shifting to a correcting operation for positioning the abnormal position of the warps Y at the operation position C (t>t2).

At this time, the correction amount calculation unit 20 calculates the corrected rotation amount θao or the corrected take-up length Lao upon receipt of the detection signal S3 (t=t2), and monitors the rotation amount θa of the take-up beam BM or the take-up length La of the take-up beam BM (t2≦t<t3). Thereafter, the correction amount calculating unit 20 outputs the stop signal S2*a* to the driving unit 30 upon detecting θa≧θao or La≧Lao (t=t3), and the driving unit 30 causes the take-up beam BM to stop at a suitable position via the braking device BK to position the abnormal portion of the warps Y at the specified operation position C.

Figure 11A:
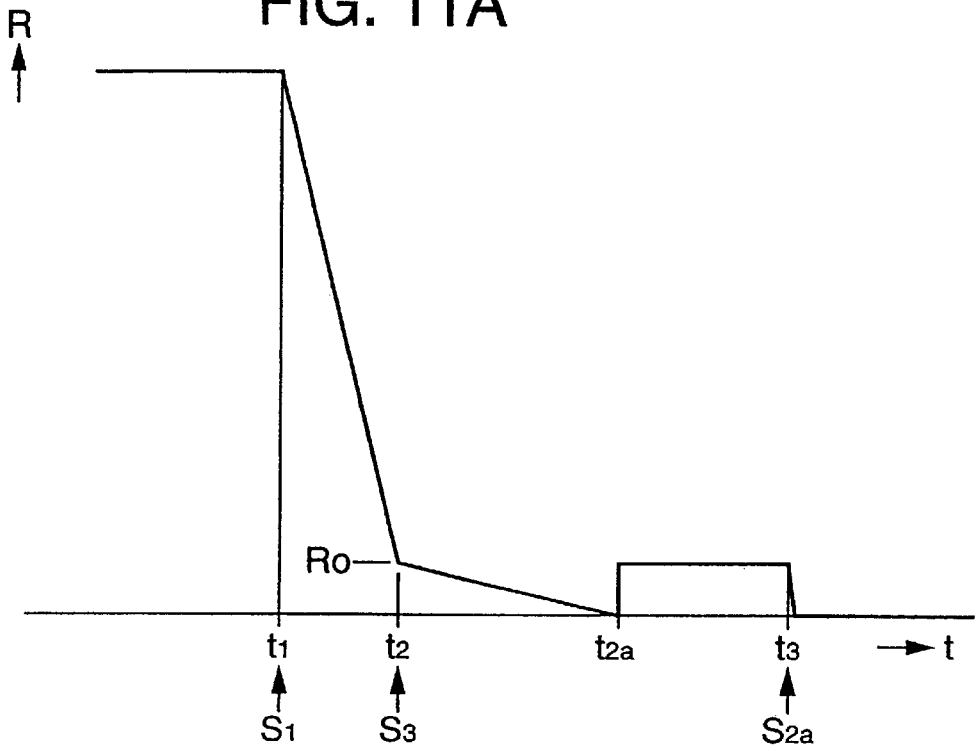
FIGS. 11A and 11B are diagrams showing the timing of the rotation number of the warper according to the embodiment of FIG. 9.
Figure 11B:
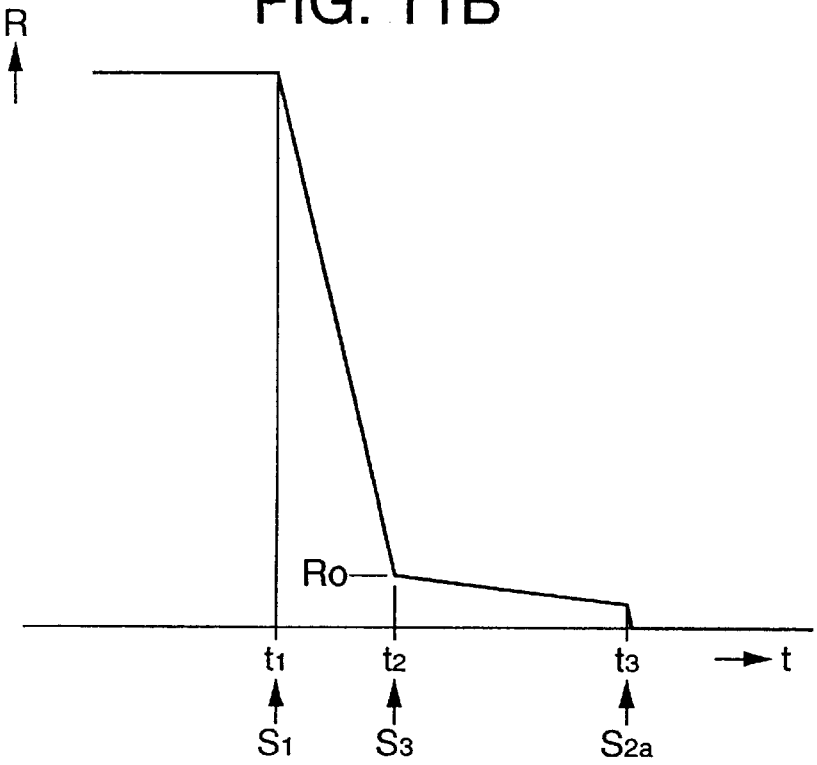

The driving unit 30 may perform a partial or the entire correcting operation for positioning the abnormal portion of the warps Y at the operation position C taking advantage of the rotation of the by take-up beam BM by inertia as shown in FIG. 11A and 11B. In other words, when the inertia driven rotation of the take-up beam BM stops during the correcting operation (t=t2a in FIG. 11A), the driving unit 30 immediately actuates the drive motor M to rotate the take-up beam BM at low speed (t2a≦t<t3), and stops the take-up beam BM via the braking device BK (t=t3) when the abnormal portion of the warps Y reaches the operation position C. Further, the driving unit 30 immediately stops the take-up beam BM via the braking device BK when the abnormal portion of the warps Y reaches the operation position C during the inertia driven rotation of the take-up beam BM (t=t3 in FIG. 11B).

Figure 12:
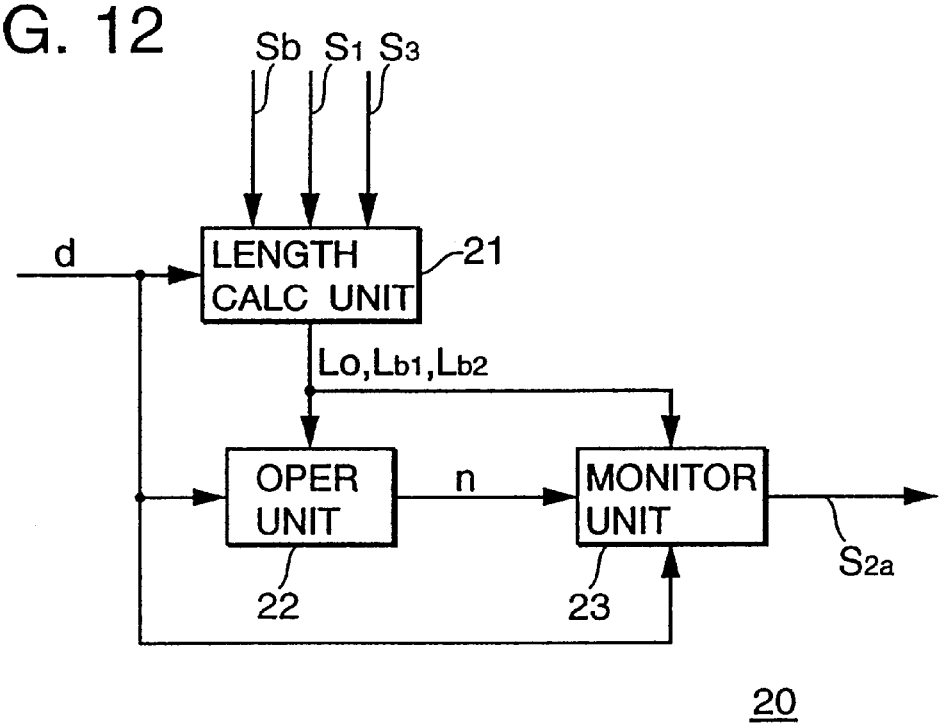
FIG. 12 is a block diagram showing a length calculating unit according to a still further embodiment of the present invention.

The length calculating unit 21 may calculate and output partial take-up lengths Lb1, Lb2 in addition to the reference length Lo as shown in FIG. 12.

The length calculating unit 21 calculates the reference length Lo and outputs it to the operating unit 22 (t=t1 in FIG. 10) upon the output of the detection signal S1 from the detector SN, for example, while the take-up beam BM rotates as in FIG. 10. Then the length calculating unit 21 calculates the partial take-up length Lb1=πd (Nb3/Nbo), by which the warps Y are taken up by the take-up beam BM during the decelerated operation (t1≦t≦t2), in real time based on the output signal Sb from the encoder ENb and the outermost diameter d of the take-up beam BM and outputs it to the operating unit 22 and the monitoring unit 23. The length calculating unit 21 also calculates the partial take-up length Lb2=πd (Nb4/Nbo), by which the warps Y are taken up by the take-up beam BM during the correcting operation (t2≦t≦t3), in real time upon the output of the detection signal S3 from the reference rotation number detector SR, and outputs it to the monitoring unit 23. It should be noted that Nb3, Nb4 denote a pulse number of the output signal Sb after the generation of the detection signal S1 and a pulse number of the output signal Sb after the generation of the detection signal S3.

On the other hand, the operating unit 22 calculates the passage number n (n=0, 1, 2, . . . ) by which the abnormal portion of the warps Y passes the operation position C based on the partial take-up length Lb1 when the detection signal S3 is generated. In other words, the operating unit 22 calculates the passage number n:

$$n=(Lb1-Lo)/(\pi d).$$

It should be noted that the passage number n=0 when $Lb1 \leqq Lo$ and $n \leqq o$ and n=a positive integer by raising decimals to the next whole number when Lb1>Lo and n>0.

The monitoring unit 23 calculates a total take-up length Lb=Lb1+Lb2 during the correcting operation based on the partial take-up length Lb1 when the detection signal S3 is generated and the partial take-up length Lb2 fed subsequently from the length calculating unit 21, and monitors it. In other words, the monitoring unit 23 detects $Lb-Lo=Lba+Lb2-Lo \geqq \pi dn$ and outputs the stop signal S2*a* when Lb−Lo becomes a multiple of the circumference (πd) of the take-up beam BM, thereby stopping the take-up beam BM at a suitable position. When $Lb1 \leqq Lo$ and n=0, the monitoring unit 23 detects $Lb=Lb1+Lb2 \geqq Lo$ and outputs the stop signal S2a. Further, when $Lo+\pi d(n-1)<Lb1 \leqq Lo+\pi dn$, the monitoring unit 23 detects $Lb=Lb1+Lb2 \geqq Lo+\pi dn$ and outputs the stop signal S2*a*.

The length calculating unit 21 may calculate the total take-up length Lb by which the warps Y are taken up by the take-up beam BM until the end of the correcting operation after the start of the decelerated rotation of the take-up beam BM instead of separately calculating the partial take-up lengths Lb1, Lb2 and calculate the total take-up length Lb: Lb=Lb1+Lb2 in the monitoring unit 23 (see FIG. 13). In such a case, the detection signal S3 is inputted to the operating unit 22. The length calculating unit 21 calculates and outputs the reference length Lo upon the generation of the detection signal S1, and calculates the total take-up length Lb=πd (Nb5/Nbo) after the generation of the detection signal S1 in real time and outputs it. It should be noted that Nb5 denotes a pulse number of the output signal Sb after the generation of the detection signal S1. On the other hand, the operating unit 22 calculates the passage number n=(Lb−Lo)/(πd) (n=0, 1, 2 . . . ) based on the total take-up length Lb and the reference length Lo when the detection signal S3 is generated the monitoring unit 23 monitors the total take-up length Lb and outputs the stop signal S2*a* upon detecting $Lb-Lo \geqq \pi dn$. In this case as well, the monitoring unit 23 outputs the stop signal S2*a* upon detecting $Lb \geqq Lo$ when $Lb \leqq Lo$ and n=0.

Figure 13:
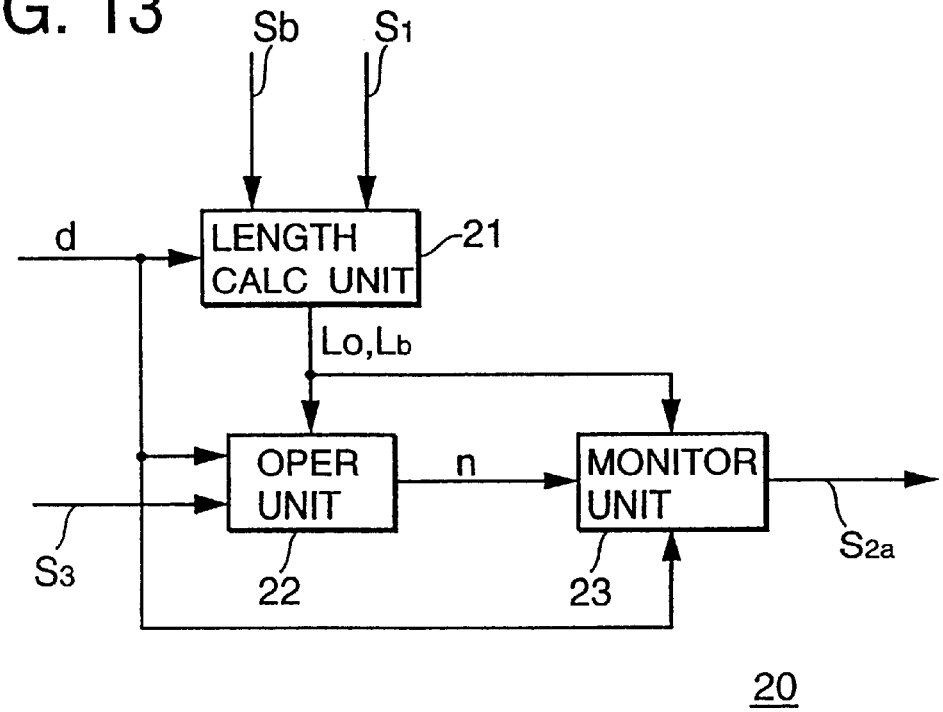
FIG. 13 is a block diagram showing a modified length calculating unit according to a still further embodiment of the present invention.

The correction amount calculation unit 20 of FIGS. 12 and 13 can easily deal with this operation even when the take-up beam BM is rotated as in shown FIG. 11. Alternatively, the correction amount calculation unit 20 of FIGS. 12 and 13 may calculate and monitor a total rotation amount θb of the take-up beam BM corresponding to the total take-up length Lb instead of calculating the total take-up length Lb or may even be used as the correction amount calculation unit 20 of FIGS. 1 to 9.

Summing up the above disclosures with reference to FIGS. 1–13, a first aspect of the invention is directed to a warp repair assisting apparatus in a warper, comprising an outermost diameter calculation unit for calculating an outermost diameter of a take-up beam, and a correction amount calculation unit to be combined with the outermost diameter calculation unit, wherein the correction amount calculation unit calculates a corrected rotation amount in the forward direction of the take-up beam, which is necessary to position an abnormal portion of warps at an operation position on the take-up beam, based on the outermost diameter fed from the outermost diameter calculation unit.

With this construction, since the correction amount calculation unit calculates the corrected rotation amount in the forward direction of the take-up beam based on the outermost diameter fed from the outermost diameter calculation unit, an operator can position the abnormal portion at the operation position on the take-up beam by rotating the take-up beam in the forward direction by the amount corresponding to the corrected rotation amount, and can quickly repair the abnormal portion at the operation position. The operation position is set beforehand in a position, for example, at an upper front position of the take-up beam where the repair can be easily made.

Preferably, the correction amount calculation unit calculates the corrected rotation amount based on a reference length from a warp monitoring position to the operation position on the take-up beam and an inertia driven running distance of the warps.

With this arrangement, the correction amount calculation unit can calculate a passage number by which the abnormal portion passes the operation position during the inertia driven running of the warps, and specify a stop position of the abnormal portion. The correction amount calculation unit can also calculate a distance from the stop position of the abnormal portion to the operation position along a running path of the warps and accurately calculate the necessary corrected rotation amount of the take-up beam based on the distance from the stop position of the abnormal portion to the operation position even if the abnormal portion passes the operation position a plurality of times during the inertia driven running.

Preferably, the correction amount calculation unit includes a monitoring unit for monitoring a rotation amount of the take-up beam.

With this arrangement, an arrival of the abnormal portion of the warps at the operation position can be detected by monitoring the rotation amount of the take-up beam by means of the monitoring unit.

Further, the correction amount calculation unit may be provided with a display device for displaying the corrected rotation amount or rotate the take-up beam via a driving unit by an amount corresponding to the corrected rotation amount.

With this arrangement, the display device can display the corrected rotation amount of the take-up beam necessary to move the abnormal portion of the warps to the operation position. The display device may display the corrected rotation amount of the take-up beam in angle or in a specified number of inching movements necessary to inch the take-up beam by a specified inching rotation amount.

The abnormal portion of the warps can be automatically positioned at the operation position via the driving unit by rotating the take-up beam by the amount corresponding to the corrected rotation amount.

The correction amount calculation unit may calculate a corrected take-up length instead of the corrected rotation amount.

With this arrangement, all of the aforementioned control modes can be easily realized based on calculating the corrected take-up length instead of the corrected rotation amount.

A second aspect of the invention is directed to a warp repair assisting apparatus in a warper, comprising an outermost diameter calculation unit for calculating an outermost diameter of a take-up beam, and a correction amount calculation unit to be combined with the outermost diameter calculation unit, wherein the correction amount calculation unit monitors a total take-up length of the take-up up beam to position an abnormal portion of warps at an operation position on the take-up beam based on the outermost diameter fed from the outermost diameter calculation unit.

With this construction, since the correction amount calculation unit monitors the total take-up length of the take-up beam based on the outermost diameter fed from the outermost diameter calculation unit, it can detect the arrival of the abnormal portion at the operation position by the rotation of the take-up beam and quickly stop the take-up beam at a suitable position. The take-up beam may be automatically stopped via the driving unit or may be manually stopped by an operator.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds are therefore intended to embraced by the claims.

What is claimed is:

1. A warp repair assisting apparatus in a warper, comprising:

an outermost diameter calculation unit for calculating an outermost diameter of a take-up beam, and a correction amount calculation unit coupled with the outermost diameter calculation unit, wherein the correction amount calculation unit includes means for calculating a corrected amount for moving the take-up beam in a forward direction to position an abnormal portion of warps in an operation position on the take-up beam using the outermost diameter calculated by the outermost diameter calculation unit.

2. The warp repair assisting apparatus according to claim 1, wherein the means for calculating a corrected amount in the correction amount calculation unit includes means for calculating a corrected rotation amount based on a reference length from a warp monitoring position to the operation position on the take-up beam and an inertia driven running distance of the warps.

3. The warp repair assisting apparatus according to claim 1, the correction amount calculation unit includes a monitoring unit for monitoring a rotation amount of the take-up beam.

4. The warp repair assisting apparatus according to claim 1, wherein the correction amount calculation unit is connected to a display device for displaying a corrected rotation amount.

5. The warp repair assisting apparatus according to claim 1, wherein the means for calculating a corrected amount in the correction amount calculation unit includes means for calculating a corrected rotation amount and the correction amount calculation unit outputs a signal to a driving unit to rotate the take-up beam by an amount corresponding to the corrected rotation amount.

6. The warp repair assisting apparatus according to claim 1, wherein the means for calculating a corrected amount in the correction amount calculation unit includes means for calculating a corrected take-up length in the forward direction of the take-up beam.

7. The warp repair assisting apparatus according to claim 1, further comprising a brake to decelerate a rotational speed of the take-up beam and a driving unit to rotate the take-up beam, wherein the correction amount calculation unit, upon receipt of a signal indicating an abnormal portion of warps, activates the brake to decelerate the rotational speed of the take-up beam and the driving unit rotates the take-up beam at a speed lower than a normal take-up speed of the take-up beam.

8. The warp repair assisting apparatus according to claim 7, wherein the correction amount calculation unit includes means to activate the brake to decelerate the rotational speed of the take-up beam to a reference speed, the correction amount calculation unit further includes means for deactivating the brake and the driving unit includes means for rotating the take-up beam at the speed substantially equal to the reference speed until the abnormal position of the warps moves to the operation position on the take-up beam.

9. The warp repair assisting apparatus according to claim 1, further comprising a brake to decelerate a rotational speed of the take-up beam, wherein the correction amount calculation unit includes means to activate the brake, upon receipt of a signal indicating an abnormal portion on the warps, to decelerate the rotational speed of the take-up beam to a reference speed and the correction amount calculation unit further includes means to deactivate the brake to let an inertia driven rotation rotate the take-up beam until the abnormal portion of the warps moves to the operation position on the take-up beam.

10. The warp repair assisting apparatus according to claim 2, further comprising a detector provided upstream of the take-up beam for detecting an abnormal portion of the warp and wherein said means for calculating the corrected rotation amount calculates the corrected rotation amount based on the reference length from the warp monitoring position detected by the detector to the operation position on the take-up beam and the inertia driven running distance of the warps.

11. A warp repair assisting apparatus in a warper, comprising:

an outermost diameter calculation unit for calculating an outermost diameter of a take-up beam, and a correction amount calculation unit coupled with the outermost diameter calculation unit, wherein the correction amount calculation unit includes means for monitoring a total take-up length of the take-up beam for positioning an abnormal portion of warps in an operation position on the take-up beam using the outermost diameter calculated by the outermost diameter calculation unit.

12. A warp repair assisting apparatus for use in a warper having a detector which detects an abnormal portion of warps and sends an abnormal portion detection signal; a take-up beam which takes up warps around the beam in a forward direction; a drive unit which rotates the take-up beam in the forward direction and stops the take-up beam respectively; the warp repair assisting apparatus comprising:

an outer diameter calculation unit for calculating an outermost diameter of the take-up beam; and a correction amount calculation means for calculating a corrected rotation amount of the take-up beam; the correction amount calculation means including:

a length calculator means for calculating, in accordance with the outermost diameter of the take-up beam, a running distance between the abnormal detection position detected by the detector, an operation position on the take-up beam and an inertia driven running distance of the warps upon receipt of the abnormal portion detection signal from the detector;

an operation unit including means for calculating the corrected rotation amount of the take-up beam based on the running distance and the inertia driven running distance; and a monitor unit including means for monitoring an operation of the drive unit so that the abnormal portion of the warps stops substantially at the operation position on the take-up beam.

13. A method of operating a warp repair assisting apparatus in a warper, said method comprising the steps of:

providing a correction amount calculation unit coupled with an outermost diameter calculation unit;

calculating an outermost diameter of a take-up beam using the outermost diameter calculation unit; and calculating a corrected amount for moving the take-up beam in a forward direction to position an abnormal portion of warps in an operation position on the take-up beam using the outermost diameter obtained in said step of calculating an outermost diameter.

14. The method according to claim 13, wherein said step of calculating an outermost diameter includes calculating a corrected rotation amount based on a reference length from a warp monitoring position to the operation position on the take-up beam and an inertia driven running distance of the warps.

15. The method according to claim 13, further comprising the step of monitoring a rotation amount of the take-up beam using a monitoring unit.

16. The method according to claim 13, further comprising the step of displaying a corrected rotation amount by a display device.

17. The method according to claim 13, wherein said step of calculating a corrected amount includes calculating a corrected rotation amount, and said method further comprising:

outputting a signal to a driving unit indicative of the corrected rotation amount obtained in said step of calculating a corrected amount; and rotating the take-up beam by an amount corresponding to the corrected rotation amount.

18. The method according to claim 13, wherein said step of calculating a corrected amount includes calculating a corrected take-up length in the forward direction of the take-up beam.

19. The method according to claim 13, further comprising the steps of:

activating a brake to decelerate the rotational speed of the take-up beam when the correction amount calculation unit receives a signal indicative of an abnormal portion of warps, and rotating the take-up beam at a speed lower than a normal take-up speed of the take-up beam.

20. The method according to claim 19, wherein said step of activating a brake includes activating the brake to decelerate the rotational speed of the take-up beam to a reference speed, and said method further comprising the steps of:

deactivating the brake when the take-up beam is rotating at the reference speed, and rotating the take-up beam at the speed substantially equal to the reference speed until the abnormal position of the warps moves to the operation position on the take-up beam.

21. The method according to claim 13, further comprising the steps of:

activating a brake to decelerate the rotational speed of the take-up beam up to a reference speed when the correction amount calculation unit receives a signal indicative of an abnormal portion of warps, and deactivating the brake so that the take-up beam rotates by inertia until the abnormal portion of the warps moves to the operation position on the take-up beam.

22. A method of operating a warp repair assisting apparatus in a warper, comprising the steps of:

providing a correction amount calculation unit coupled with an outermost diameter calculation unit, calculating an outermost diameter of a take-up beam using the outermost diameter calculation unit, and monitoring a total take-up length of the take-up beam for positioning an abnormal portion of warps in an operation position on the take-up beam using the outermost diameter obtained in said step of calculating.

23. A method of operating a warp repair assisting apparatus for use in a warper, said method comprising the steps of:

providing a take-up beam for taking up warps around the take-up beam in a forward direction;

providing a driving unit for rotating the take-up beam in the forward direction and for stopping the take-up beam;

detecting an abnormal portion of warps on the take-up beam by a detector;

sending an abnormal portion detection signal from the detector to a correction amount calculation unit;

calculating an outermost diameter of the take-up beam using an outer diameter calculation unit; and calculating a corrected rotation amount of the take-up beam using the correction amount calculation unit; said step of calculating a corrected rotation amount including:

calculating a running distance between the abnormal detection position detected by the detector, an operation position on the take-up beam and an inertia driven running distance of the warps, upon receipt of the abnormal portion detection signal from the detector;

calculating the corrected rotation amount of the take-up beam based on the running distance and the inertia driven running distance; and monitoring an operation of the drive unit so that the abnormal portion of the warps stops substantially at the operation position on the take-up beam.

* * * * *